US007392885B2

(12) United States Patent
Wang

(10) Patent No.: US 7,392,885 B2
(45) Date of Patent: Jul. 1, 2008

(54) EMERGENCY ESCAPE APPARATUS FOR ELEVATOR

(76) Inventor: Chiu Nan Wang, No. 50 Alley 97, Lane 354, San Her Rd., Feng Yuan, Taichung Hsien (TW)

( * ) Notice: Subject to any disclaimer, the term of this patent is extended or adjusted under 35 U.S.C. 154(b) by 33 days.

(21) Appl. No.: 11/504,791

(22) Filed: Aug. 14, 2006

(65) Prior Publication Data

US 2008/0078625 A1 Apr. 3, 2008

(51) Int. Cl.
*B66B 11/08* (2006.01)
*B66B 1/40* (2006.01)
*B66B 1/06* (2006.01)
*B66B 1/02* (2006.01)

(52) U.S. Cl. ..... 187/263; 187/291; 187/298; 187/306

(58) Field of Classification Search ..... 187/263, 187/290, 291, 298, 305, 306, 377
See application file for complete search history.

(56) References Cited

U.S. PATENT DOCUMENTS 5,680,911 A * 10/1997 Wang ..... 187/263
5,713,433 A * 2/1998 Wang ..... 187/263
5,890,565 A * 4/1999 Wang ..... 187/263
6,116,380 A * 9/2000 Wang ..... 187/263
6,179,090 B1 * 1/2001 Casas ..... 187/377
6,273,216 B1 * 8/2001 Kocher et al. ..... 187/377
6,464,043 B2 * 10/2002 Wang ..... 187/314
6,516,921 B1 * 2/2003 Wang ..... 187/263
6,557,670 B2 * 5/2003 Wang ..... 187/290
6,739,431 B1 * 5/2004 Wang ..... 187/306
6,817,453 B2 * 11/2004 Koeppe, Jr. ..... 188/171
6,966,409 B2 * 11/2005 Wang ..... 187/290
7,032,714 B2 * 4/2006 Wang ..... 187/311

* cited by examiner

*Primary Examiner*—Peter M. Cuomo
*Assistant Examiner*—Eric Pico

(57) ABSTRACT

An emergency escape apparatus for elevator is disclosed. In response to power outage manually pulling an actuation rope will pivot a pivot bar counterclockwise to rotate front and rear cams, press front and rear cams onto front and rear actuation members respectively, lower a pinion to be in mesh with a gear on a front of a drive sheave, press pressing rollers onto hoist ropes, activate a bar member to deactivate a brake, close a switch, and activate a backup motor to turn the pinion and the drive sheave through the gear, thereby lowering a car until a safe floor is reached. In another operation speeding the car will automatically enable an electromagnetic actuator to pull the actuation rope and activate a main motor to lower the car.

5 Claims, 8 Drawing Sheets

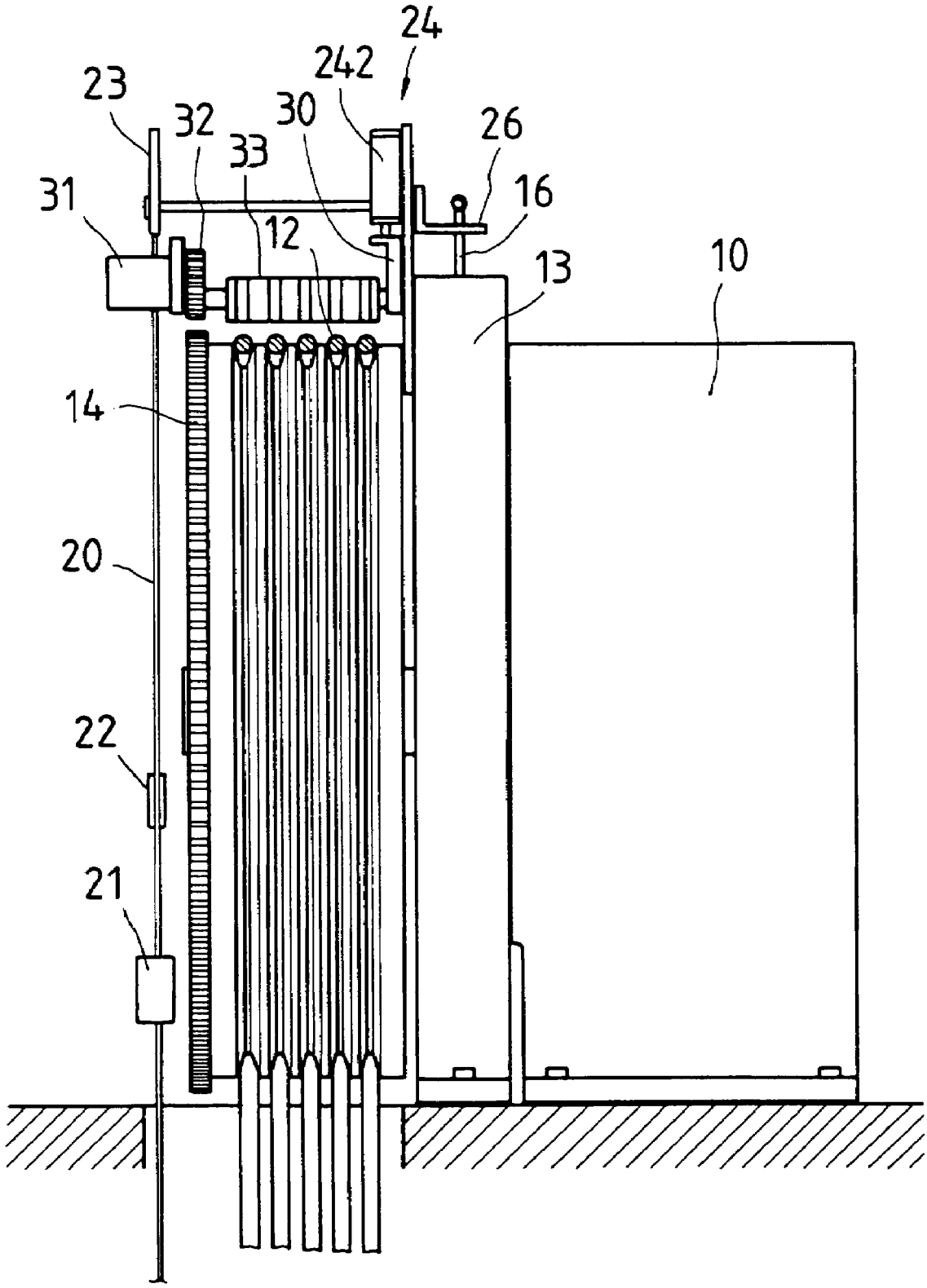
FIG, 7

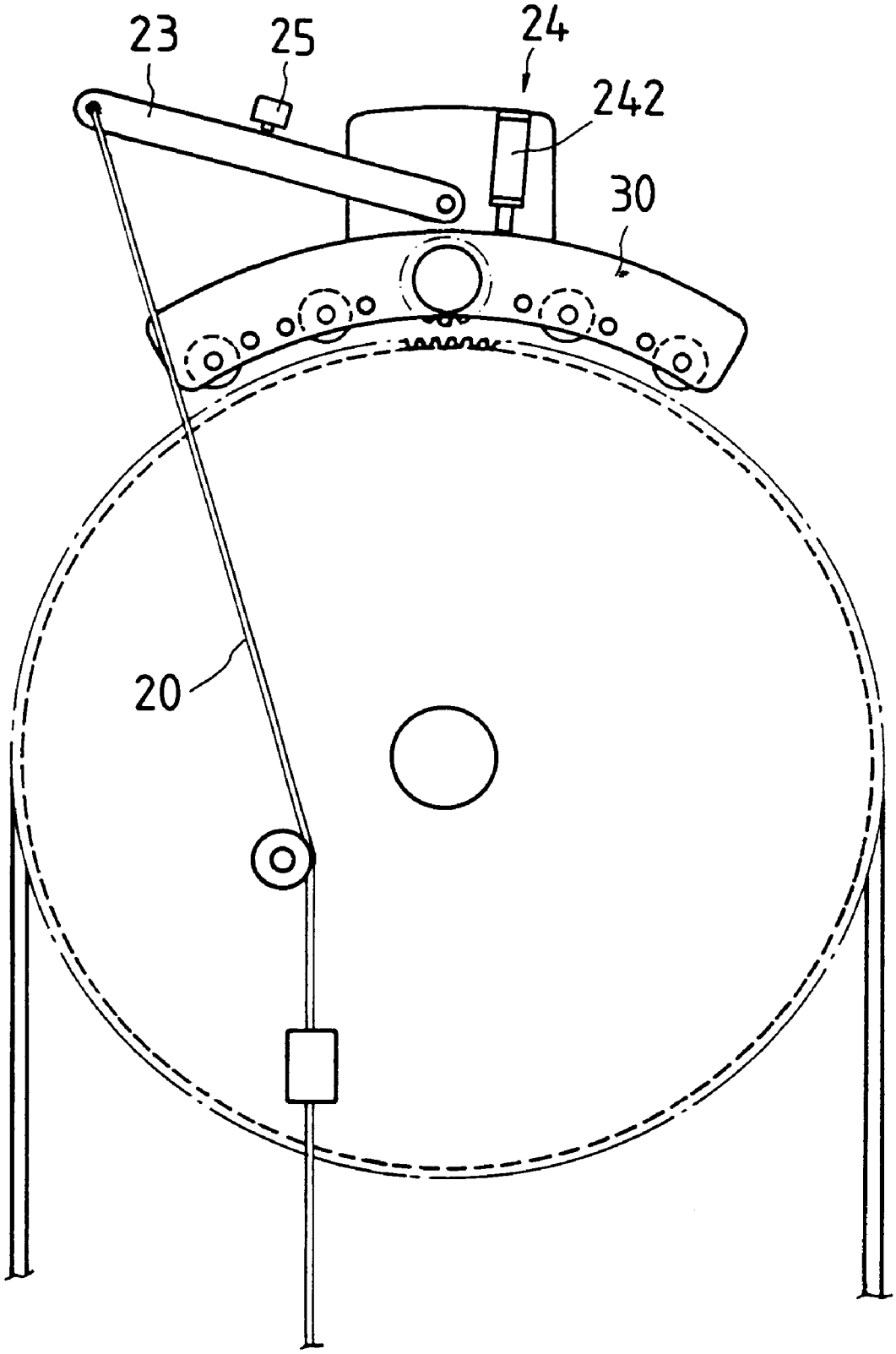
FIG, 8

EMERGENCY ESCAPE APPARATUS FOR ELEVATOR

BACKGROUND OF THE INVENTION

1. Field of Invention

The invention relates to emergency escape arrangements for an elevator and more particularly to such an emergency escape apparatus for an elevator with improved characteristics.

2. Related Art

Elevators are requisite equipment for high rise buildings. It is known that an elevator is required to incorporate a safety device in order to satisfy stringent safety requirements and stricter safety codes.

One typical safety device is brake which is provided between a car and a car guide rail. The brake is adapted to stop the car from falling freely in case of emergency such as power outage or overspeed of the car because of faulty speed regulation. Typically, should an emergency situation arises and after activating the brake, an elevator technician is called to go to a panel room to manually activate a drive sheave to lift or lower a car to a desired floor. Thereafter, reset the brake and thus return the elevator to its ready state. However, this procedure is very inconvenient. Further, it involves technician. Unfortunately, this is not practical since all persons trapped in an elevator car may have died before an elevator technician arrives. Furthermore, after activating the brake, a main motor may rotate without load due to insufficient friction between hoist ropes and a drive sheave. In addition, conventional elevators rely on the main motor as drive source (i.e., no backup motor). This means that escape is impossible in case of power outage or the main motor malfunctioning. Thus, a need for improvement still exists.

SUMMARY OF THE INVENTION

It is therefore an object of the present invention to provide an emergency escape apparatus for an elevator including a main motor, a drive sheave, a plurality of hoist ropes rotatably put on the drive sheave, a brake, a counterweight, and a car, comprising a gear mounted on a front end of the drive sheave; a bar member operatively connected to the brake; an actuation rope having one end terminated at a wall of the car; an electromagnetic actuator mounted on the actuation rope; a pivot bar having one end connected to the other end of the actuation rope; a front cam adjacent the pivot bar; a rear cam adjacent the bar member; a switch adjacent the rear cam; a first shaft connected through the pivot bar and the front and rear cams; a curved front actuation member mounted below the front cam; a curved rear actuation member mounted below the rear cam; a backup power supply; a backup motor mounted in front of the front actuation member and operatively connected thereto; a pinion in a rear of the front actuation member; a plurality of pressing rollers mounted above the hoist ropes; and a second shaft rotatably connecting the actuation members, the pinion, and the pressing rollers together; whereby in response to power outage manually pulling the actuation rope will pivot the pivot bar counterclockwise to rotate both the front and rear cams, press the front and rear cams onto the front and rear actuation members respectively, lower the pinion to be in mesh with the gear, press the pressing rollers onto the hoist ropes, activate the bar member to deactivate the brake, close the switch, and activate the backup motor to turn the pinion and the drive sheave through the gear, thereby lowering the car until a predetermined floor is reached; and whereby speeding the car will automatically enable the electromagnetic actuator to pull the actuation rope, pivot the pivot bar counterclockwise to rotate both the front and rear cams, press the front and rear cams onto the front and rear actuation members respectively, lower the pinion to be in mesh with the gear, press the pressing rollers onto the hoist ropes, activate the bar member to deactivate the brake, close the switch, and activate the main motor to lower the car until a predetermined floor is reached.

It is another object of the present invention to provide an emergency escape apparatus for an elevator including a main motor, a drive sheave, a plurality of hoist ropes rotatably put on the drive sheave, a brake, a counterweight, and a car, comprising a gear mounted on a front end of the drive sheave; a bar member operatively connected to the brake; an actuation rope having one end terminated at a wall of the car; an electromagnetic actuator mounted on the actuation rope; a pivot bar having one end connected to the other end of the actuation rope; a rear plunger; a switch adjacent the plunger; a curved front actuation member mounted below the front cam; a curved rear actuation member mounted below the plunger; a backup power supply; a backup motor mounted in front of the front actuation member and operatively connected thereto; a pinion in a rear of the front actuation member; a plurality of pressing rollers mounted above the hoist ropes; and a shaft rotatably connecting the actuation members, the pinion, and the pressing rollers together; whereby in response to power outage manually pulling the actuation rope will pivot the pivot bar counterclockwise to press the plunger onto and lower the rear actuation member, lower the pinion to be in mesh with the gear, press the pressing rollers onto the hoist ropes, activate the bar member to deactivate the brake, close the switch, and activate the backup motor to turn the pinion and the drive sheave through the gear, thereby lowering the car until a predetermined floor is reached; and whereby speeding the car will automatically enable the electromagnetic actuator to pull the actuation rope, pivot the pivot bar counterclockwise to press the plunger onto and lower the rear actuation member, lower the pinion to be in mesh with the gear, press the pressing rollers onto the hoist ropes, activate the bar member to deactivate the brake, close the switch, and activate the main motor to lower the car until a predetermined floor is reached.

In one aspect of the present invention each of the pressing rollers has an annular groove.

In another aspect of the present invention there are further provided a second actuation rope having one end terminated at a wall of the car, a second electromagnetic actuator mounted on the second actuation rope, a second pivot bar having one end connected to the other end of the second actuation rope, and a second switch. Closing the second switch in response to pulling the second actuation rope will clockwise pivot the second pivot bar, and counterclockwise rotate the backup motor to hoist the car.

The above and other objects, features and advantages of the present invention will become apparent from the following detailed description taken with the accompanying drawings.

BRIEF DESCRIPTION OF THE DRAWINGS

FIG. 7 is a side elevation of a third preferred embodiment of emergency escape apparatus for elevator according to the present invention; and FIG. 8 is a front view of FIG. 7.

DETAILED DESCRIPTION OF THE INVENTION

Figure 1:
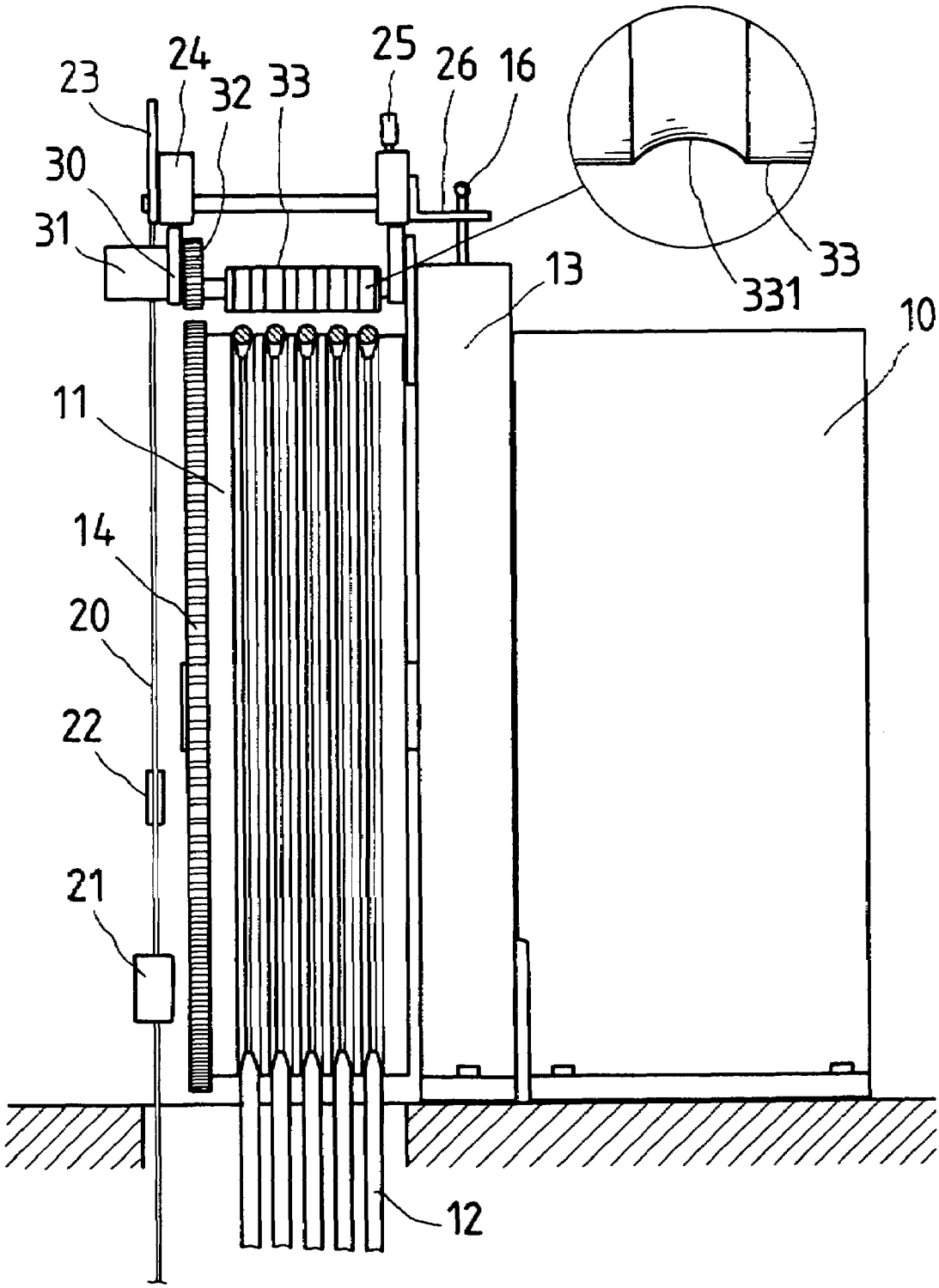
FIG. 1 is a side elevation of a first preferred embodiment of emergency escape apparatus for elevator according to the present invention.
Figure 2:
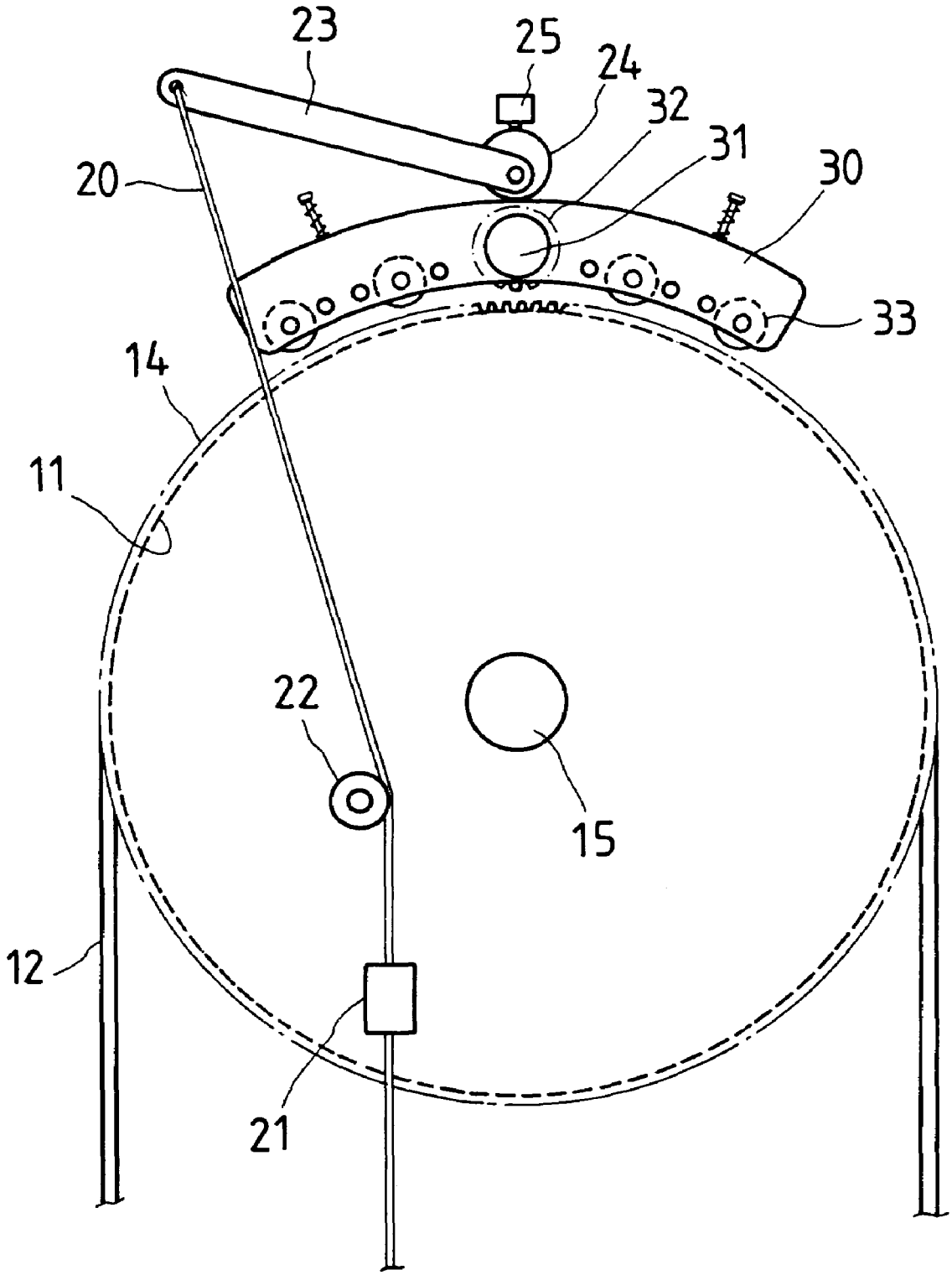
FIG. 2 is a front view of FIG. 1.

Referring to FIGS. 1 to 4, an emergency escape apparatus for elevator in accordance with a first preferred embodiment of the present invention is shown. The emergency escape apparatus comprises the following components.

A main motor 10 has a rotating shaft 15 rotatably connected to a drive sheave 11. The rotating drive sheave 11 is adapted to drive a plurality of hoist ropes 12 put on annular rope grooves (not numbered) on the drive sheave 11. As a result, a car (not shown) of an elevator (not shown) can be driven to hoist or lower. A brake 13 is provided between the main motor 10 and the drive sheave 11. A gear 14 is provided on a front end of the drive sheave 11. A brake lever 16 is provided on a top of the brake 13 and is adapted to activate or deactivate the brake 13. A bar member 26 is provided above the brake 13 and is operatively connected to the brake lever 16.

An actuation rope 20 has one end terminated at a wall of the car such that a trapped person may pull the actuation rope 20 for escape in case of emergency as detailed later. An electromagnetic actuator 21 is provided on the actuation rope 20 and is adapted to enable to pull the actuation rope 20. A roller 22 having a grooved rim is provided above the electromagnetic actuator 21 and is adapted to guide the actuation rope 20 run therethrough. The other end of the actuation rope 20 is connected to an open end of a pivot bar 23. A drive member 24 comprises two spaced cams 241 interconnected by a shaft (not numbered) which is again connected to the other end of the pivot bar 23. Front and rear actuation members 30 are provided between the drive sheave 11 and the drive member 24. The actuation member 30 is an arcuate plate in which the rear actuation member 30 is proximate the brake 13 and disposed below the rear cam 241. There are further provided a front, small backup motor 31 which is powered by a backup power supply (e.g., a rechargeable battery (not shown)), proximate the front actuation member 30, and disposed below the front cam 241, a pinion 32 proximate the front actuation member 30, intermediate pressing rollers 33 having an annular groove 331 provided above the hoist ropes 12, and a shaft (not numbered) connecting the actuation members 30, the pinion 32, and the pressing rollers 33 together. A switch 25 is provided above the rear cam 241.

Figure 3:
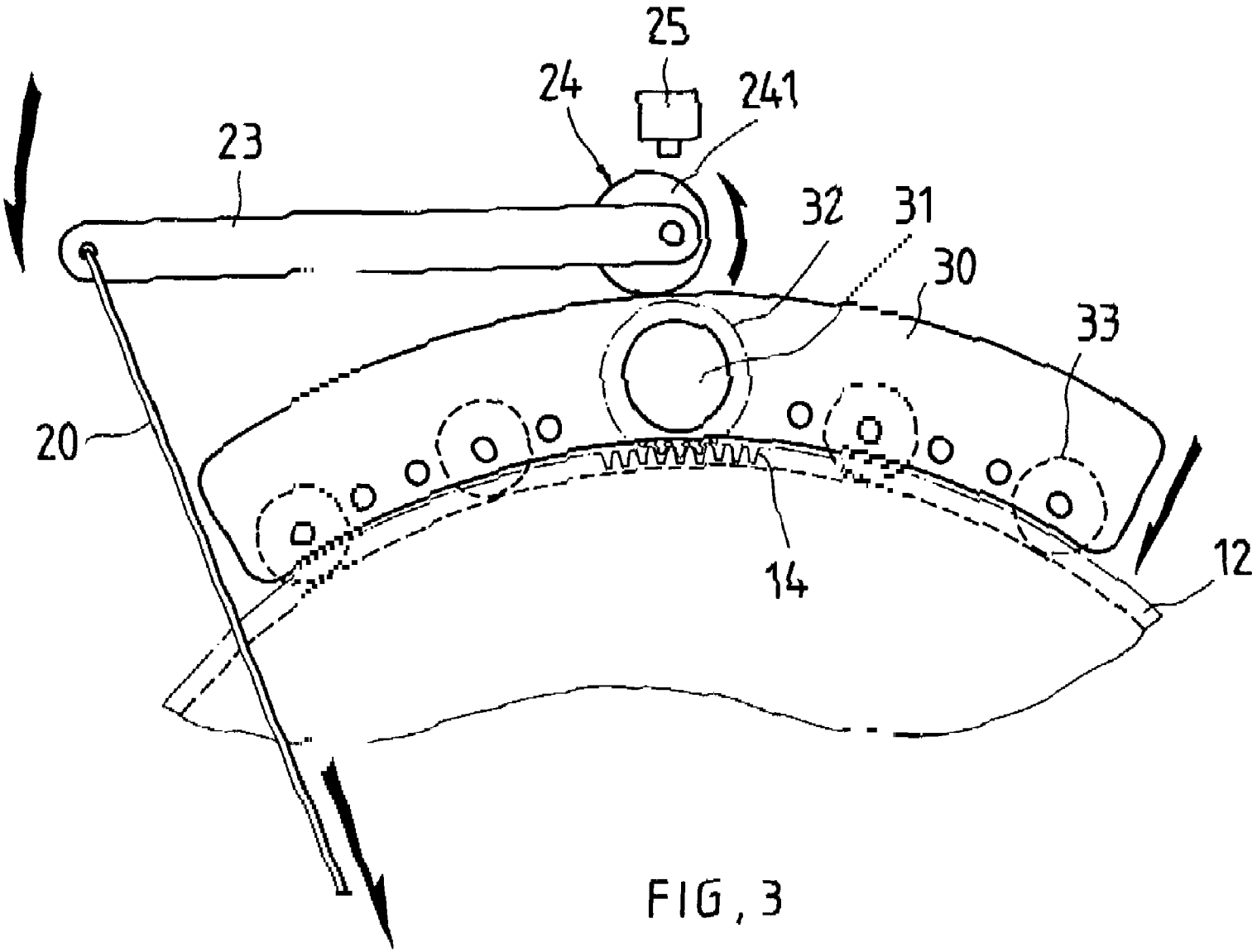
FIG. 3 is an enlarged fragmentary view depicting details of the components shown in an upper portion of FIG. 2 in operation.
Figure 4:
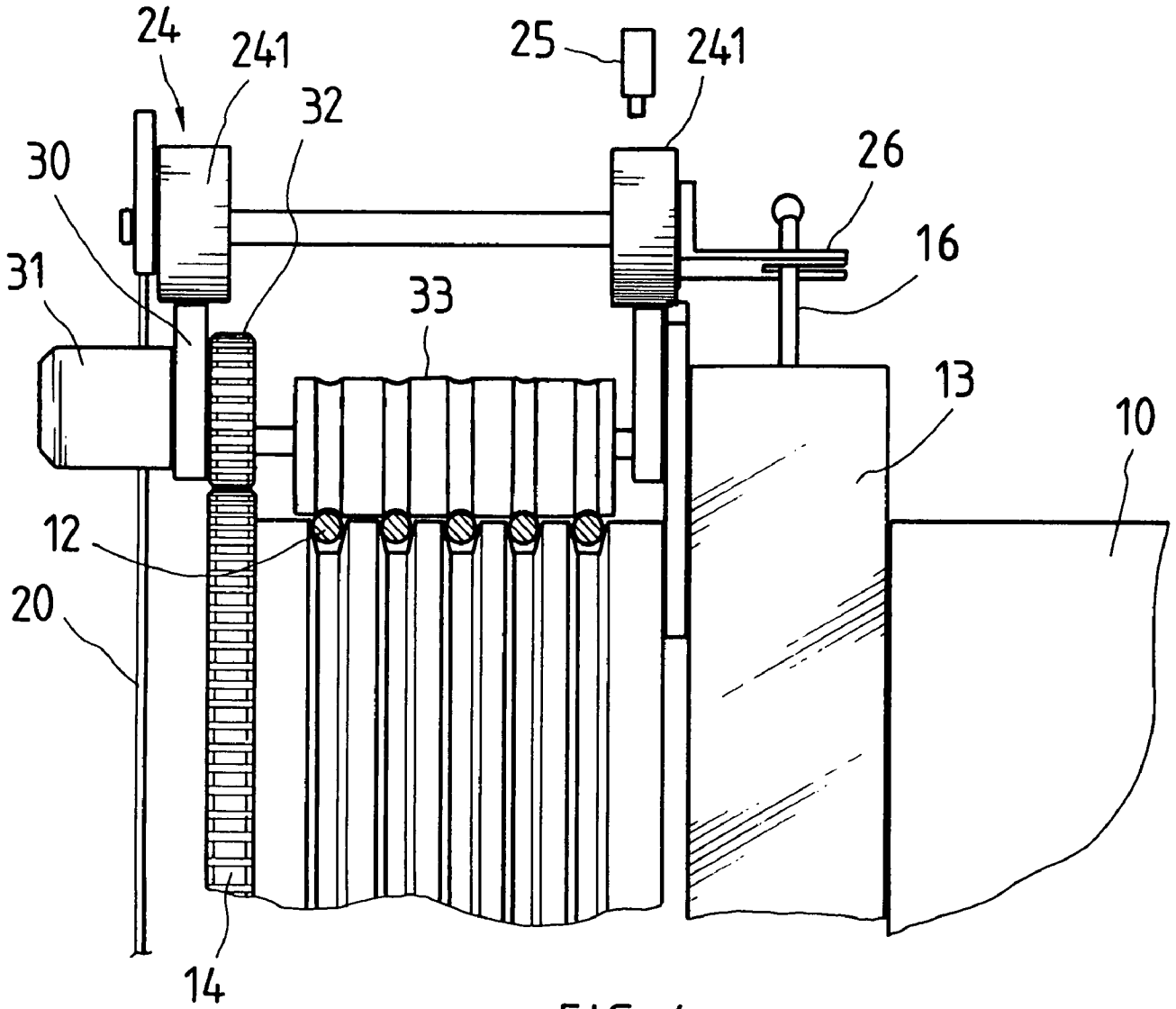
FIG. 4 is an enlarged fragmentary view depicting details of the pressing rollers urged against the hoist ropes shown in FIG. 1 in operation.

An operation of the present invention will be described in detailed below by referring to FIGS. 3 and 4 specifically. Should an emergency situation arises due to power outage or overspeed of the car because of faulty speed regulation or the like, either a person trapped in the car may manually pull the actuation rope 20 in case of power outage or the actuation rope 20 may be activated (i.e., pulled down) automatically by the enabled electromagnetic actuator 21 in case of no power outage. And in turn the pivot bar 23 pivots counterclockwise to rotate both the front and rear cams 241. The front cam 241 in turn presses down the front actuation member 30 and the rear cam 241 in turn presses down the rear actuation member 30 respectively. Further, the pinion 32 lowers to be in mesh with the gear 14 and the hoist ropes 12 are thus tightly pressed by the grooves 331 of the pressing rollers 33. This can increase friction for preventing the hoist ropes 12 from slipping. Also, the bar member 26 is activated automatically to pivot to enable the brake lever 16 to deactivate the brake 13. At the same time, the switch 25 is closed. Thus, the person trapped in the car can safely escape by lowering the car to a nearest floor either by the activated main motor 10 in case of normal power supply (i.e., the car connected to the hoist ropes 12 is lowered by the activated main motor 10) or by simply exerting a minimum pulling force upon the actuation rope 20 (i.e., trigger) because most power comes from the activated backup motor 31 in case of power outage (i.e., the car is lowered by the activated backup motor 31 through the meshing of the pinion 32 and the gear 14).

Figure 5:
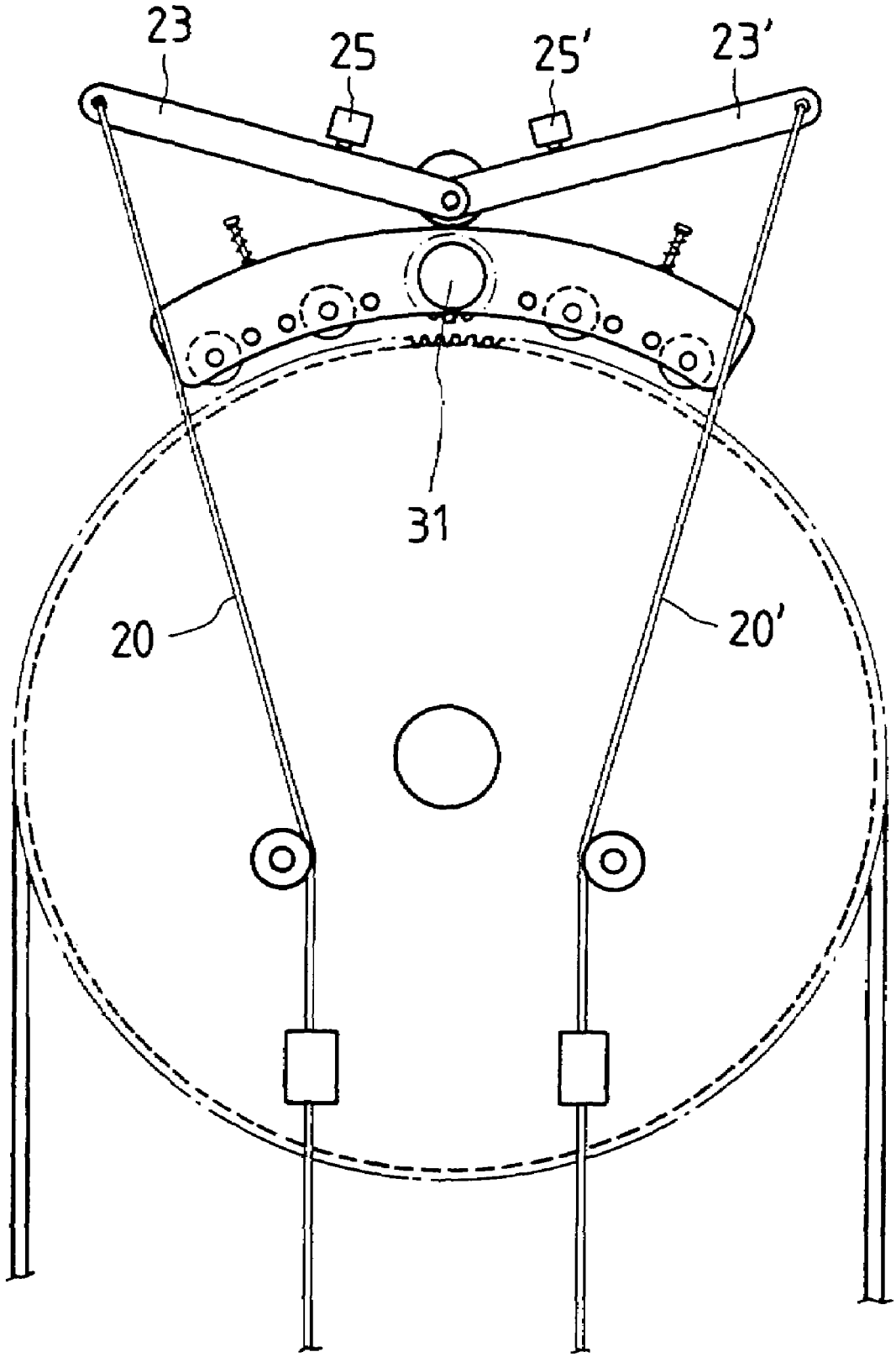
FIG. 5 is a front view of a second preferred embodiment of emergency escape apparatus for elevator according to the present invention.

Referring to FIG. 5, an emergency escape apparatus for elevator in accordance with a second preferred embodiment of the present invention is shown. The second embodiment is identical to the first embodiment, except that the actuation rope and other associated components are provided in a pair (e.g., actuation rope 20 and actuation rope 20'), the pivot bar is provided in a pair (e.g., pivot bar 23 and pivot bar 23'), and the switch is provided in a pair (e.g., switch 25 and switch 25'). Further, the switch 25 is closed in response to pulling the actuation rope 20 and thus counterclockwise pivoting the pivot bar 23. Hence, the backup motor 31 rotates clockwise, resulting in a downward travel of the car. To the contrary, the switch 25' is closed in response to pulling the actuation rope 20' and thus clockwise pivoting the pivot bar 23'. Hence, the backup motor 31 rotates counterclockwise, resulting in an upward travel of the car.

Figure 6:
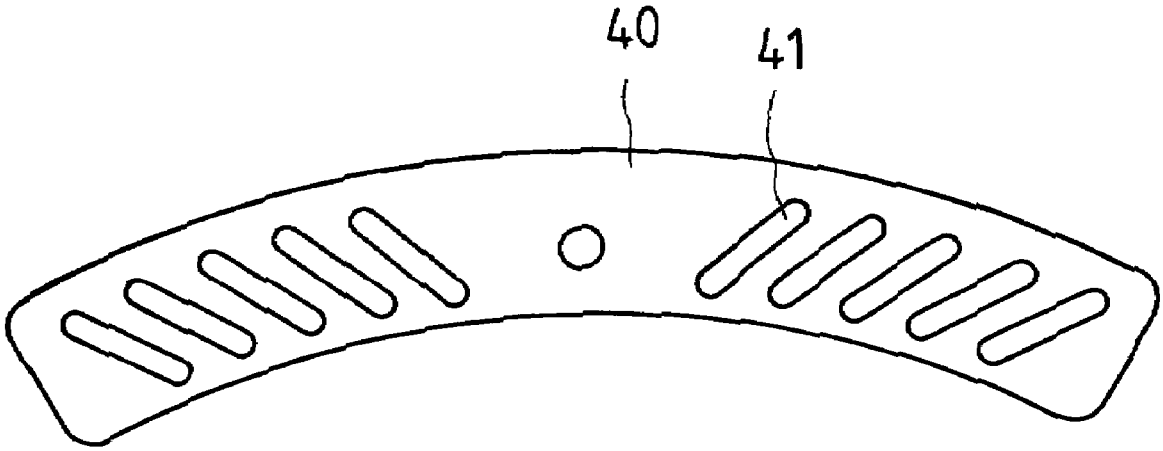
FIG. 6 is a side elevation of another configuration of actuation member according to the present invention.

Referring to FIG. 6, another actuation member 40 in accordance with the present invention is shown. The actuation member 40 comprises a plurality of inclined elongate slots 41 at either half portion. The actuation member 40 is adapted to accommodate a drive sheave having a diameter other than one shown in either preferred embodiment of the present invention.

Referring to FIGS. 7 and 8, an emergency escape apparatus for elevator in accordance with a third preferred embodiment of the present invention is shown. The third embodiment is identical to the first embodiment, except that the drive member 24 is implemented as a single plunger and cylinder combination 242. In operation, pulling the actuation rope 20 will counterclockwise turn the pivot bar 23. The switch 25 is then closed. The plunger and cylinder combination 242 is then activated to press down the actuation member 30. Further, the pinion 32 lowers to be in mesh with the gear 14 and the hoist ropes 12 are thus tightly pressed by the grooves 331 of the pressing rollers 33. This can increase friction for preventing the hoist ropes 12 from slipping. Also, the bar member 26 is activated automatically to pivot to enable the brake lever 16 to deactivate the brake 13. At the same time, the switch 25 is closed. Thus, the person trapped in the car can safely escape by lowering the car to a nearest floor either by the activated main motor 10 in case of normal power supply (i.e., the car connected to the hoist ropes 12 is lowered by the activated main motor 10) or by simply exerting a minimum pulling force upon the actuation rope 20 (i.e., trigger) because most power comes from the activated backup motor 31 in case of power outage (i.e., the car is lowered by the activated backup motor 31 through the meshing of the pinion 32 and the gear 14).

It is to be understood that the present invention is by no means limited only to the particular constructions herein disclosed and shown in the drawings, but also comprises any modifications or equivalents within the scope of the claims.

What is claimed is:

1. An emergency escape apparatus for an elevator including a main motor, a drive sheave, a plurality of hoist ropes rotatably put on the drive sheave, a brake, a counterweight, and a car, comprising:

a gear mounted on a front end of the drive sheave;

a bar member operatively connected to the brake;

an actuation rope having one end terminated at a wall of the car;

an electromagnetic actuator mounted on the actuation rope;

a pivot bar having one end connected to the other end of the actuation rope;

a front cam adjacent the pivot bar;

a rear cam adjacent the bar member;

a switch adjacent the rear cam;

a first shaft connected through the pivot bar and the front and rear cams;

a curved front actuation member mounted below the front cam;

a curved rear actuation member mounted below the rear cam;

a backup power supply;

a backup motor mounted in front of the front actuation member and operatively connected thereto;

a pinion in a rear of the front actuation member;

a plurality of pressing rollers mounted above the hoist ropes; and a second shaft rotatably connecting the actuation members, the pinion, and the pressing rollers together;

whereby in response to power outage manually pulling the actuation rope will pivot the pivot bar counterclockwise to rotate the front and rear cams, press the front and rear cams onto the front and rear actuation members respectively, lower the pinion to be in mesh with the gear, press the pressing rollers onto the hoist ropes, activate the bar member to deactivate the brake, close the switch, and activate the backup motor to turn the pinion and the drive sheave through the gear, thereby lowering the car until a predetermined floor is reached; and whereby speeding the car will automatically enable the electromagnetic actuator to pull the actuation rope, pivot the pivot bar counterclockwise to rotate the front and rear cams, press the front and rear cams onto the front and rear actuation members respectively, lower the pinion to be in mesh with the gear, press the pressing rollers onto the hoist ropes, activate the bar member to deactivate the brake, close the switch, and activate the main motor to lower the car until a predetermined floor is reached.

2. The emergency escape apparatus of claim 1, wherein each of the pressing rollers has an annular groove.

3. The emergency escape apparatus of claim 1, further comprising a second actuation rope having one end terminated at a wall of the car, a second electromagnetic actuator mounted on the second actuation rope, a second pivot bar having one end connected to the other end of the second actuation rope, and a second switch, and whereby closing the second switch in response to pulling the second actuation rope will clockwise pivot the second pivot bar, and counterclockwise rotate the backup motor to hoist the car.

4. An emergency escape apparatus for an elevator including a main motor, a drive sheave, a plurality of hoist ropes rotatably put on the drive sheave, a brake, a counterweight, and a car, comprising:

a gear mounted on a front end of the drive sheave;

a bar member operatively connected to the brake;

an actuation rope having one end terminated at a wall of the car;

an electromagnetic actuator mounted on the actuation rope;

a pivot bar having one end connected to the other end of the actuation rope;

a rear plunger;

a switch adjacent the plunger;

a curved front actuation member mounted below the front cam;

a curved rear actuation member mounted below the plunger;

a backup power supply;

a backup motor mounted in front of the front actuation member and operatively connected thereto;

a pinion in a rear of the front actuation member;

a plurality of pressing rollers mounted above the hoist ropes; and a shaft rotatably connecting the actuation members, the pinion, and the pressing rollers together;

whereby in response to power outage manually pulling the actuation rope will pivot the pivot bar counterclockwise to press the plunger onto and lower the rear actuation member, lower the pinion to be in mesh with the gear, press the pressing rollers onto the hoist ropes, activate the bar member to deactivate the brake, close the switch, and activate the backup motor to turn the pinion and the drive sheave through the gear, thereby lowering the car until a predetermined floor is reached; and whereby speeding the car will automatically enable the electromagnetic actuator to pull the actuation rope, pivot the pivot bar counterclockwise to press the plunger onto and lower the rear actuation member, lower the pinion to be in mesh with the gear, press the pressing rollers onto the hoist ropes, activate the bar member to deactivate the brake, close the switch, and activate the main motor to lower the car until a predetermined floor is reached.

5. The emergency escape apparatus of claim 4, wherein each of the pressing rollers has an annular groove.

* * * * *